US010578134B2

(12) United States Patent
Takeda

(10) Patent No.: US 10,578,134 B2
(45) Date of Patent: Mar. 3, 2020

(54) FLUID PRESSURE CYLINDER

(71) Applicant: SMC CORPORATION, Chiyoda-ku (JP)

(72) Inventor: Kenichi Takeda, Noda (JP)

(73) Assignee: SMC CORPORATION, Chiyoda-ku (JP)

( * ) Notice: Subject to any disclaimer, the term of this patent is extended or adjusted under 35 U.S.C. 154(b) by 155 days.

(21) Appl. No.: 15/544,462

(22) PCT Filed: Jan. 5, 2016

(86) PCT No.: PCT/JP2016/000025
§ 371 (c)(1),
(2) Date: Jul. 18, 2017

(87) PCT Pub. No.: WO2016/117284
PCT Pub. Date: Jul. 28, 2016

(65) Prior Publication Data
US 2018/0266449 A1 Sep. 20, 2018

(30) Foreign Application Priority Data
Jan. 19, 2015 (JP) ..... 2015-007497

(51) Int. Cl.
*F15B 15/14* (2006.01)
*F15B 15/28* (2006.01)

(52) U.S. Cl.
CPC ..... *F15B 15/1414* (2013.01); *F15B 15/1471* (2013.01); *F15B 15/2807* (2013.01); *F15B 2211/7051* (2013.01)

(58) Field of Classification Search
CPC ..... F15B 15/2807
USPC ..... 92/165 PR
See application file for complete search history.

(56) References Cited

U.S. PATENT DOCUMENTS 2,327,920 A 8/1943 Moohl
3,313,215 A 4/1967 Bieri
3,797,365 A 3/1974 Yoshikawa
(Continued)

FOREIGN PATENT DOCUMENTS

FR 2 635 361 A1 2/1990
FR 2 789 616 A1 8/2000
(Continued)

OTHER PUBLICATIONS

Office Action dated Aug. 1, 2017 in Japanese Patent Application No. 2015-007497 (with English language translation).
(Continued)

*Primary Examiner* — Thomas E Lazo
*Assistant Examiner* — Matthew Wiblin
(74) *Attorney, Agent, or Firm* — Oblon, McClelland, Maier & Neustadt, L.L.P.

(57) ABSTRACT

A fluid pressure cylinder is equipped with a piston rod connected coaxially with a piston and which slides linearly in the interior of a body. A cutout recess having a predetermined length along an axial direction of the piston rod is formed on a side surface of the piston rod. A planar bearing is provided, which projects toward the cutout recess from an inner surface of the body, and includes a distal end surface that abuts on the same plane with a bottom surface of the cutout recess.

6 Claims, 4 Drawing Sheets

(56) References Cited

U.S. PATENT DOCUMENTS

| | | | | | |
|---|---|---|---|---|---|
| 3,994,539 | A * | 11/1976 | Gottlieb | F15B 15/1414 384/49 |
| 4,982,652 | A * | 1/1991 | Blatt | F15B 15/2815 200/82 E |
| 5,568,760 | A * | 10/1996 | Volzer | F15B 15/2846 92/165 PR |
| 5,974,948 | A * | 11/1999 | Thompson | F15B 15/2892 92/165 PR |
| 6,931,982 | B1 * | 8/2005 | Zajac, Jr. | F15B 15/1414 92/165 PR |
| 7,219,495 | B2 * | 5/2007 | Ludsteck | F16D 25/088 60/584 |
| 8,015,914 | B2 * | 9/2011 | Huang | A47C 3/30 248/188.2 |
| 2005/0087068 | A1 | 4/2005 | Nagai et al. | |
| 2006/0196354 | A1 | 9/2006 | Garcia et al. | |

FOREIGN PATENT DOCUMENTS

| | | | |
|---|---|---|---|
| JP | 48-33507 | Y | 10/1973 |
| JP | 60-80831 | U | 6/1985 |
| JP | 7-266171 | A | 10/1995 |
| JP | 2000-27811 | A | 1/2000 |
| JP | 3187471 | U | 11/2013 |
| KR | 10-2005-0039672 | A | 4/2005 |
| RU | 2 478 856 | C1 | 4/2013 |
| SU | 1041775 | A | 9/1983 |
| SU | 1 351 306 | A1 | 11/1995 |

OTHER PUBLICATIONS

Combined Office Action and Search Report dated Apr. 23, 2018 in Chinese Patent Application No. 201680006243.3 (with English language translation) citing references AA-AB and AO therein, 12 pages.

Combined Russian Office Action and Search Report dated Aug. 1, 2018 in Russian Patent Application No. 2017125933 (with English translation), citing documents AO, AP and AQ therein, 10 pages.

Korean Office Action dated Aug. 30, 2018 in Korean Patent Application No. 10-2017-7020261 (with English translation), citing documents AR and AS therein , 8 pages.

International Search Report and Written Opinion of the International Searching Authority dated Mar. 30, 2016 in PCT/JP2016/000025 filed Jan. 5, 2016.

* cited by examiner

[Fig. 1]
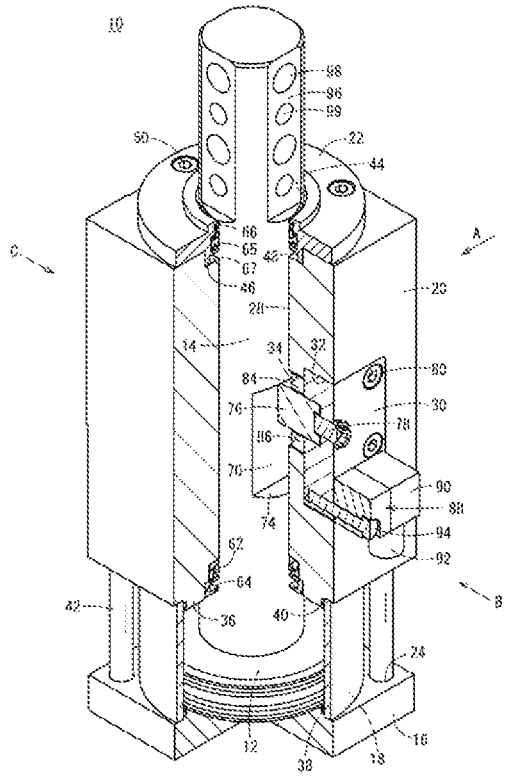
[Fig. 2]
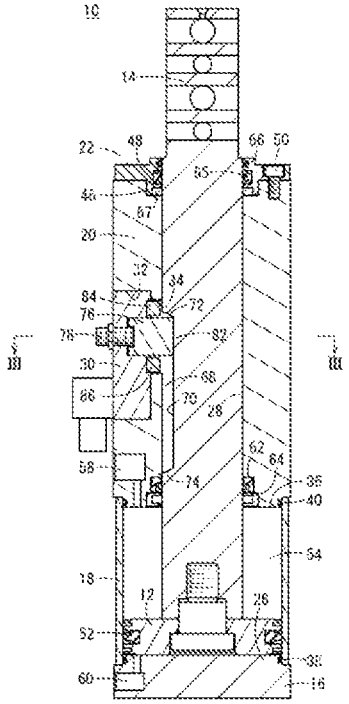

[Fig. 3]
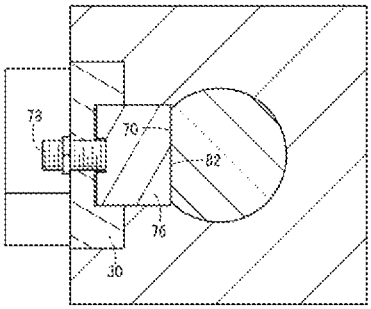
[Fig. 4]
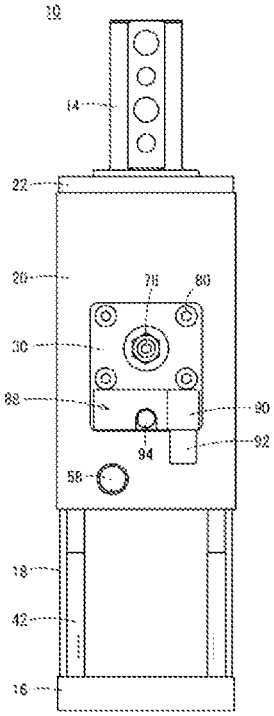

[Fig. 5]
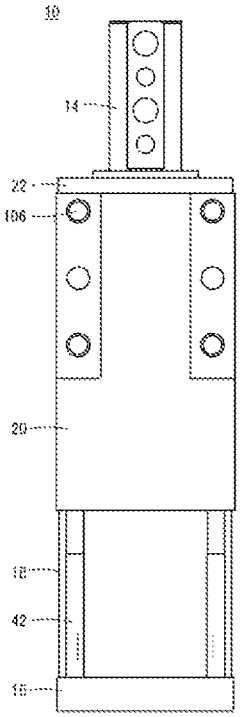
[Fig. 6]
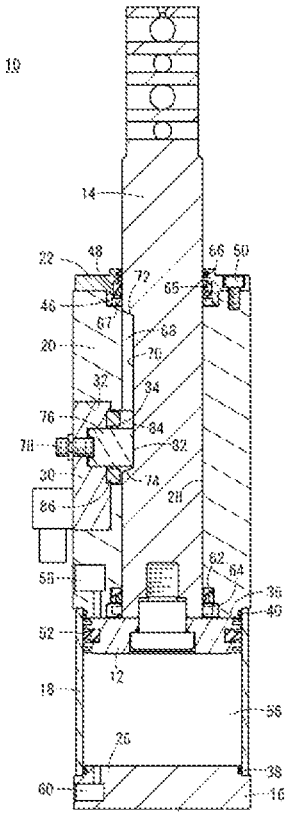

[Fig. 7]
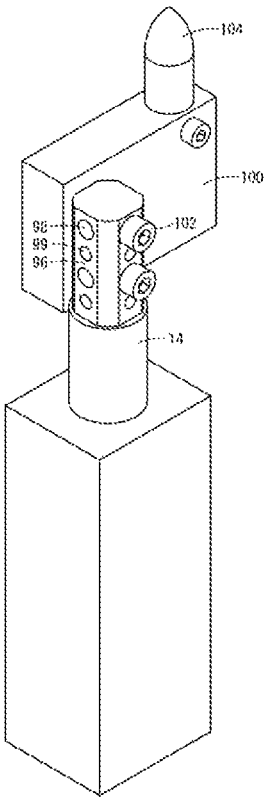

FLUID PRESSURE CYLINDER

TECHNICAL FIELD

The present invention relates to a fluid pressure cylinder, and in particular, concerns a fluid pressure cylinder equipped with a rod that slides linearly in the interior of a body.

BACKGROUND ART

Heretofore, for example, a fluid pressure cylinder has been known, in which a workpiece positioning pin is attached at an eccentric position with respect to an end of a rod that is connected coaxially with a piston, such that the workpiece positioning pin can be moved or shifted in position. With such a fluid pressure cylinder, for ensuring that the positioning pin does not rotate about the axis of the fluid pressure cylinder, there is a need to prevent the rod from rotating.

As one technique for preventing rotation of the rod, a shaft member is provided, which extends perpendicularly with respect to the axis of the rod from a side surface of the rod, and the shaft member is supported and guided in a guide groove that is formed in the body (see French Patent Application Publication No. 2789616).

With the fluid pressure cylinder of French Patent Application Publication No. 2789616, for detecting a stroke end of the piston, a structure is added in which a groove is formed in the rod, together with a magnetic sensor being disposed in the body.

SUMMARY OF INVENTION

However, with the fluid pressure cylinder of French Patent Application Publication No. 2789616, for stopping the rotational torque transmitted from the workpiece at a connecting portion between the shaft member and the rod, it is necessary for the connecting portion to be of high strength and structural integrity. Further, due to the fact that detection means for detecting the stroke end of the piston is provided separately from the rod rotation prevention means for preventing rotation of the rod, problems occur in that the apparatus becomes complex and larger in scale.

The present invention has been devised taking into consideration the aforementioned problems. An object of the present invention is to provide a fluid pressure cylinder which, with a simple structure, is capable of reliably preventing a rod from rotating. Further, another object of the present invention is to simplify the structure of the apparatus as a whole, by using a part of the rod rotation prevention means as a detection means for detecting the stroke end of the piston.

A fluid pressure cylinder according to the present invention comprises a rod connected coaxially with a piston and which slides linearly inside a body, wherein a recess having a predetermined length along an axial direction of the rod is formed on a side surface of the rod, and a planar bearing is provided, which projects toward the recess from an inner surface of the body, and includes a distal end surface that abuts on the same plane with a bottom surface of the recess.

According to the fluid pressure cylinder described above, rotation of the rod can reliably be prevented by causing the distal end surface of the planar bearing disposed in the body to come into abutment on the same plane with the bottom surface of the recess that is formed on the side surface of the rod.

In the above-described fluid pressure cylinder, a non-contact type proximity sensor preferably is disposed inside the body adjacent to the planar bearing, the proximity sensor being adapted to detect an axial end part of the recess. According to this feature, using the recess, which is formed as a rod rotation prevention means, the stroke end of the piston can be detected, and the structure of the apparatus as a whole can be simplified.

The rod preferably is axially supported as a result of being fitted substantially without gaps into a fitting hole of the body excluding a region where the recess is formed. According to this feature, aside from being able to axially support and stabilize the rod over a wide area, the total length of the fluid pressure cylinder can be shortened.

The fluid pressure cylinder further includes a unit configured to adjust an amount of projection of the planar bearing. According to this feature, a clearance between the bottom surface of the recess and the distal end surface of the planar bearing can easily be set and adjusted, and thus, in addition to enabling the precision in stopping rotation of the rod to be enhanced, changes that take place over time can be compensated for.

Further still, a grease reservoir or a lubrication oil retaining member may be disposed in the body corresponding to a location where the rod extends out from the body. According to this feature, smooth sliding of the rod can be maintained over a long period of time.

Further, a workpiece positioning pin may be disposed on one end side of the rod. According to this feature, even if a rotational torque is received from the workpiece, a fluid pressure cylinder can be provided that is capable of stabilizing and supporting the workpiece.

With the fluid pressure cylinder according to the present invention, rotation of the rod can reliably be prevented by causing the distal end surface of the planar bearing disposed in the body to come into abutment on the same plane with the bottom surface of the recess that is formed on the side surface of the rod. Further, using the recess, which is formed as rod rotation prevention means, the stroke end of the piston can be detected, and the structure of the apparatus as a whole can be simplified.

The above and other objects, features and advantages of the present invention will become more apparent from the following description when taken in conjunction with the accompanying drawings, in which preferred embodiments of the present invention are shown by way of illustrative example.

BRIEF DESCRIPTION OF DRAWINGS

FIG. 1 is a perspective view showing, with a portion thereof cut away, a fluid pressure cylinder according to an embodiment of the present invention;

FIG. 2 is a vertical cross-sectional view as seen from the direction of the arrow A of the fluid pressure cylinder shown in FIG. 1;

FIG. 3 is a cross-sectional view taken along line III-III of the fluid pressure cylinder shown in FIG. 2;

FIG. 4 is a side view as seen from the direction of the arrow B of the fluid pressure cylinder shown in FIG. 1;

FIG. 5 is a side view as seen from the direction of the arrow C of the fluid pressure cylinder shown in FIG. 1;

FIG. 6 is a vertical cross-sectional view as seen from the direction of the arrow A, at a time that the fluid pressure cylinder shown in FIG. 1 has been operated to an upward stroke end position; and FIG. 7 is a perspective view of essential components when a jig is attached to a piston rod of the fluid pressure cylinder shown in FIG. 1.

DESCRIPTION OF EMBODIMENTS

Below, a preferred embodiment of a fluid pressure cylinder according to the present invention will be described with reference to the accompanying drawings. In the following description, when the terms "upper" or "lower" are used, such terms refer to the up and down vertical directions in the drawings.

As shown in FIGS. 1 through 6, a fluid pressure cylinder 10 according to the embodiment of the present invention is made up from a piston 12, a piston rod (rod) 14, an end cover 16, a cylinder tube 18, a body 20, a scraper holder 22, and so forth.

The end cover 16 is a member made from a thick-walled rectangular plate formed with through holes 24 for connecting bolts formed in the four corners thereof. A circular projecting step 26 is formed on an upper surface of the end cover 16.

The body 20 is a columnar member with a substantially square outer shape in cross section, including a piston rod fitting hole 28 that penetrates vertically therethrough. An inner diameter of the piston rod fitting hole 28 is approximately the same as the outer diameter of the piston rod 14. A rectangular recess 32 for attachment therein of a later-described bearing bracket 30 is formed in a side surface of the body 20. A bottom surface of the rectangular recess 32 includes a hole 34 therein that penetrates through to the piston rod fitting hole 28. On a lower end surface of the body 20, a circular projecting step 36 is formed, and screw holes (not shown) for screw-engagement therein of connecting bolts are formed in the four corners of the body 20.

The cylinder tube 18 is a thin-walled cylindrical member, a lower end of which is fitted onto an outer circumference of a projecting step 26 of the end cover 16, and an upper end of which is fitted onto an outer circumference of the projecting step 36 of the body 20. Sealing rings 38, 40 are installed, respectively, on the outer circumference of the projecting step 26 of the end cover 16, and on the outer circumference of the projecting step 36 of the body 20.

Connecting bolts 42 are inserted from the respective connecting bolt holes 24 of the end cover 16, and having passed over the outer side of the cylinder tube 18, are screw-engaged in screw holes of the body 20. Consequently, the end cover 16, the cylinder tube 18, and the body 20 are connected together integrally.

The scraper holder 22 is an annular plate-shaped member having a piston rod insertion hole 44 in the center thereof. The scraper holder 22 has an annular projecting member 46 on a lower surface. The projecting member 46 of the scraper holder 22 is fitted into a circular recess 48 of the body 20 that is formed on an upper side of the piston rod fitting hole 28, and is fixed to the body 20 by a plurality of scraper holder attachment bolts 50.

The piston 12, which is circular in cross-section, is arranged slidably in the interior of a cylinder chamber defined by an upper surface of the end cover 16, an inner wall surface of the cylinder tube 18, and a lower surface of the body 20. A piston packing 52 is mounted on an outer circumferential surface of the piston 12, and the cylinder chamber is partitioned by the piston 12 into a first pressure chamber 54 on an upward side of the piston 12, and a second pressure chamber 56 on a downward side of the piston 12. A first port 58 connected to the first pressure chamber 54 is disposed on a side surface near the lower end of the body 20, and a second port 60 connected to the second pressure chamber 56 is disposed on a side surface of the end cover 16.

The piston rod 14, which is connected to the piston 12, is fitted substantially without gaps into the piston rod fitting hole 28 of the body 20 excluding a region where a later-described cutout recess 68 is formed. One end of the piston rod 14 passes through the piston rod insertion hole 44 of the scraper holder 22 and projects upwardly of the scraper holder 22. On a lower end inner circumference of the body 20, a rod packing 62 is mounted in sliding contact with the piston rod 14, and a grease reservoir 64 also is provided. A scraper 65 and a metal scraper 66 disposed in sliding contact with the piston rod 14 are installed on the inner circumference of the scraper holder 22. Further, a grease reservoir 67 is disposed between the body 20 and the scraper holder 22 corresponding to a location where the piston rod 14 extends out from the body 20.

A cutout recess (recess) 68, which spans over a predetermined length in the axial direction, is formed on a side surface of the piston rod 14 that is positioned inside the body 20. A lower surface 70 of the cutout recess 68 is formed as a plane in parallel with the axis of the piston rod 14, whereas both ends in the axial direction of the cutout recess 68 are formed by inclined surfaces 72, 74, which are inclined with respect to the axis of the piston rod 14.

On the inner surface of the body 20 confronting the cutout recess 68 of the piston rod 14, a planar bearing 76 of a quadrangular columnar shape is provided, which projects towards the cutout recess 68. The planar bearing 76 is mounted on a bearing bracket 30 through an adjusting means 78 that is constituted from a bolt and a nut, such that an amount of projection of the planar bearing 76 can be adjusted. The bearing bracket 30 is fitted into the rectangular recess 32 of the body 20, and is fixed to the body 20 by a plurality of bearing bracket attachment bolts 80. A distal end surface 82 of the planar bearing 76 is constituted by a plane that is parallel to the axis of the piston rod 14, and the total surface thereof abuts against the bottom surface 70 of the cutout recess 68.

A first proximity sensor 84 and a second proximity sensor 86, which are non-contact type sensors, are disposed inside the hole 34 of the body 20, adjacent to an upper side and a lower side of the planar bearing 76. The first proximity sensor 84 and the second proximity sensor 86 are attached to the bearing bracket 30, such that distal ends thereof oppose the outer circumferential surface of the piston rod 14 in a state of being slightly retracted from the inner surface of the body 20.

A sensor bracket 88 equipped with an amplifier 90 and a connector 92 is fixed to an outer side of the bearing bracket 30 using a sensor bracket fixing jig 94. Signals detected by the first proximity sensor 84 and the second proximity sensor 86 are led out to the exterior by a signal line (not shown) that extends from the connector 92.

An end of the piston rod 14 that projects upwardly from the scraper holder 22 includes four flat portions 96 that are formed by cutting out four side surfaces with planes parallel to the axial direction of the piston rod 14 at intervals of 90 degrees, respectively. On the piston rod 14, along respective opposing pairs of the flat portions 96, a pair of large diameter through holes 98 and a pair of small diameter through holes 99, which penetrate perpendicularly to the axis of the piston rod 14, are formed alternately in the vertical direction alongside one another.

As shown in FIG. 7, using an appropriate one from among the flat portion 96, a jig 100 made up from a thick-walled rectangular plate is fixed to the projecting end of the piston rod 14. More specifically, a location proximate a short side of one of the surfaces of the jig 100 is placed in abutment against a predetermined one of the flat portions 96, jig attachment bolts 102 are inserted through the pair of large diameter through holes 98 from a flat portion 96 opposite thereto, and the jig attachment bolts 102 are screw-engaged in screw holes (not shown) that are formed in the jig 100. At this time, pins (not shown) that project from the jig 100 are fitted into the pair of small diameter through holes 99. A workpiece positioning pin 104, which projects upwardly in parallel with the axis of the piston rod 14, is disposed on the jig 100 at a position separated from the projecting end of the piston rod 14.

Reference numeral 106 in FIG. 5 refers to fastener insertion holes for fixing the fluid pressure cylinder 10 to a non-illustrated workpiece positioning apparatus main body.

The fluid pressure cylinder 10 according to the present embodiment is constructed basically as has been described above. Next, with reference to FIGS. 2 and 6, operations and effects of the fluid pressure cylinder 10 will be described.

A pressure fluid is supplied to the second pressure chamber 56, and pressure fluid is discharged from the first pressure chamber 54, whereupon the piston rod 14 undergoes sliding movement together with the piston 12 upwardly along the piston rod fitting hole 28 of the body 20. When the piston 12 abuts against the lower surface of the body 20 and reaches the upper stroke end, the second proximity sensor 86 surpasses the inclined surface 74 on the lower end side of the cutout recess 68 of the piston rod 14 and confronts the outer circumferential surface of the piston rod 14, whereby it is detected that the piston 12 has reached the upper stroke end (see FIG. 6). At this time, the workpiece positioning pin 104 of the jig 100 is fitted into a workpiece fitting hole, and positioning and fixing of the workpiece is carried out.

After a prescribed operation such as welding or the like has been performed on the workpiece, pressure fluid is supplied to the first pressure chamber 54, and pressure fluid is discharged from the second pressure chamber 56, whereupon the piston rod 14 undergoes sliding movement together with the piston 12 downwardly along the piston rod fitting hole 28 of the body 20. Then, when the piston 12 abuts against the upper surface of the end cover 16 and reaches the lower stroke end, the first proximity sensor 84 surpasses the inclined surface 72 on the upper end side of the cutout recess 68 of the piston rod 14 and confronts the outer circumferential surface of the piston rod 14, whereby it is detected that the piston 12 has reached the lower stroke end (see FIG. 2). At this time, the workpiece positioning pin 104 of the jig 100 is disengaged from the workpiece fitting hole.

An amount of projection of the distal end surface 82 of the planar bearing 76 is adjusted beforehand by the adjusting means 78 so that the clearance between the distal end surface 82 and the bottom surface 70 of the cutout recess 68 is minimized. Further, the piston rod 14 is axially supported as a result of being fitted substantially without gaps in the piston rod fitting hole 28 of the body 20. Owing thereto, the entirety of the distal end surface 82 of the planar bearing 76 abuts against the bottom surface 70 of the cutout recess 68, whereby a sufficient reactive force can be imparted with respect to the rotational force transmitted to the piston rod 14 from the workpiece. Consequently, rotation of the piston rod 14 is reliably prevented over the entire stroke range of the piston 12.

With the fluid pressure cylinder 10 according to the present invention, rotation of the piston rod 14 can reliably be prevented by causing the distal end surface 82 of the planar bearing 76 disposed in the body 20 to come into abutment on the same plane (flat surface to flat surface) with the bottom surface 70 of the cutout recess 68 that is formed on the side surface of the piston rod 14.

Further, since the first proximity sensor 84 and the second proximity sensor 86 are configured to detect the outer circumferential surface of the piston rod 14 at both ends in the axial direction of the cutout recess 68, a portion of the piston rod 14 rotation prevention means can be used as a detection means for detecting the stroke end of the piston 12, and thus, the structure of the apparatus as a whole can be simplified.

Furthermore, since the piston rod 14 is fitted substantially without gaps in the piston rod fitting hole 28 of the body 20 excluding the region where the cutout recess 68 is formed, aside from being able to axially support and stabilize the piston rod 14 over a wide area, the total length of the fluid pressure cylinder 10 can be shortened.

Further still, since the adjusting means 78 is included, which is capable of adjusting the amount of projection of the planar bearing 76, a clearance between the bottom surface 70 of the cutout recess 68 and the distal end surface 82 of the planar bearing 76 can easily be set and adjusted, and thus, in addition to enabling the precision in stopping rotation of the piston rod 14 to be enhanced, changes that take place over time can be compensated for.

According to the present embodiment, although the grease reservoir 64 is disposed on a lower end inner circumference of the body 20, instead of the grease reservoir 64, a lubrication oil retaining member may be provided. Further, although the grease reservoir 67 is disposed between the body 20 and the scraper holder 22, instead of the grease reservoir 67, a lubrication oil retaining member may be provided.

The fluid pressure cylinder according to the present invention is not limited to the above-described embodiment. It goes without saying that various additional or modified structures may be adopted therein without departing from the scope of the invention as set forth in the appended claims.

The invention claimed is:

1. A fluid pressure cylinder comprising a rod connected coaxially with a piston and which slides linearly inside a body, wherein:

a recess having a predetermined length along an axial direction of the rod is formed on a side surface of the rod; and an adjustable planar bearing is provided, which projects toward the recess from an inner surface of the body, and includes a distal end surface that abuts on a plane that is coplanar with a bottom surface of the recess, wherein the distal end surface has a quadrangular shape as seen in the direction of adjustment of the planar bearing, and in a direction orthogonal to the distal end surface of the planar bearing, and the recess does not have a side surface that extends in the axial direction of the rod.

2. The fluid cylinder according to claim 1, wherein a non-contact type proximity sensor is disposed inside the body adjacent to the planar bearing, the proximity sensor being adapted to detect an axial end part of the recess.

3. The fluid pressure cylinder according to claim 1, wherein the rod is axially supported as a result of being fitted substantially without gaps into a fitting hole of the body excluding a region where the recess is formed.

4. The fluid pressure cylinder according to claim 1, further comprising a unit configured to adjust an amount of projection of the planar bearing.

5. The fluid pressure cylinder according to claim 1, wherein a grease reservoir or a lubrication oil retaining member is disposed in the body corresponding to a location where the rod extends out from the body.

6. The fluid pressure cylinder according to claim 1, wherein a workpiece positioning pin is disposed on an end side of the rod.

* * * * *